US007051892B1

(12) United States Patent
O'Day, Jr.

(10) Patent No.: US 7,051,892 B1
(45) Date of Patent: May 30, 2006

(54) WATER BOTTLE FOR A DISPENSER

(76) Inventor: William R. O'Day, Jr., 165 Ocean St., P.O. Box 515, Brant Rock, MA (US) 02020

( * ) Notice: Subject to any disclaimer, the term of this patent is extended or adjusted under 35 U.S.C. 154(b) by 0 days.

(21) Appl. No.: 10/975,295

(22) Filed: Oct. 28, 2004

Related U.S. Application Data

(63) Continuation-in-part of application No. 29/209,236, filed on Jul. 12, 2004.

(60) Provisional application No. 60/554,037, filed on Mar. 16, 2004, provisional application No. 60/542,167, filed on Feb. 5, 2004, provisional application No. 60/515,067, filed on Oct. 28, 2003.

(51) Int. Cl.
*B65D 23/00* (2006.01)

(52) U.S. Cl. ..... 215/383; 215/10; 215/382; 220/672; 220/675

(58) Field of Classification Search ..... 215/379, 215/381–383, 10; 220/669, 671, 672, 675, 220/DIG. 13
See application file for complete search history.

(56) References Cited

U.S. PATENT DOCUMENTS 262,232 A * 8/1882 Kowalevsky ..... 220/4.25
519,486 A 5/1894 Waite
1,341,826 A * 6/1920 Stewart ..... 215/388
2,098,823 A 11/1937 Gurley
D136,997 S * 1/1944 Clark ..... D9/541
2,745,642 A 5/1956 Hermann
2,917,766 A * 12/1959 Ciffo ..... 206/15.2
3,289,874 A * 12/1966 Dailey et al. ..... 215/11.6
3,434,637 A * 3/1969 Marcel ..... 222/570
3,827,595 A * 8/1974 Reynolds ..... 220/661
4,170,622 A 10/1979 Uhlig
4,308,955 A * 1/1982 Schieser et al. ..... 206/509
4,380,306 A * 4/1983 Knopf ..... 222/89
D280,707 S * 9/1985 Imanishi ..... D9/519
4,579,242 A * 4/1986 Ellis, III ..... 220/4.13
4,749,092 A * 6/1988 Sugiura et al. ..... 215/381
4,794,880 A * 1/1989 Atchley ..... 119/72.5
4,938,395 A * 7/1990 Jamieson ..... 222/478
4,972,976 A * 11/1990 Romero ..... 222/185.1
D318,614 S * 7/1991 Sheridan ..... D9/519
5,137,162 A * 8/1992 Fritz ..... 215/40
5,603,176 A * 2/1997 Eddins et al. ..... 40/409
5,638,982 A * 6/1997 Spector ..... 220/630
5,750,224 A 5/1998 Quasters
D403,243 S 12/1998 Takeuchi et al.
6,042,022 A * 3/2000 Rogozinski et al. ..... 239/211
D423,360 S * 4/2000 Hirato et al. ..... D9/504
D434,663 S 12/2000 Jones et al.
D448,300 S 9/2001 Walters et al.
D452,446 S 12/2001 Shear
D459,657 S 7/2002 Estep (Continued)

FOREIGN PATENT DOCUMENTS

DE 3406986 A1 * 8/1985

(Continued)

*Primary Examiner*—Sue A. Weaver
(74) *Attorney, Agent, or Firm*—John P. McGonagle

(57) ABSTRACT

A plastic, blow-molded, disposable water bottle adapted for use with a dispenser, said bottle having a basically spherical or elliptical shape, a footed base portion, and a unique neck geometry.

2 Claims, 16 Drawing Sheets

U.S. PATENT DOCUMENTS

| | | | | |
|---|---|---|---|---|
| D460,693 | S * | 7/2002 | Flowers | D9/519 |
| D469,361 | S | 1/2003 | Zhou | |
| 6,666,358 | B1 * | 12/2003 | Field | 222/400.7 |
| D490,714 | S | 6/2004 | Snyder | |
| 6,845,889 | B1 * | 1/2005 | Killoran et al. | 222/212 |
| D509,742 | S * | 9/2005 | Biondich et al. | D9/519 |
| 2004/0065635 | A1 * | 4/2004 | Turnbough | 215/11.1 |

FOREIGN PATENT DOCUMENTS

| | | | |
|---|---|---|---|
| DE | 10115135 | A1 * | 10/2002 |
| EP | 1177988 | A1 * | 2/2002 |
| JP | 11208633 | A * | 8/1999 |

* cited by examiner

WATER BOTTLE FOR A DISPENSER

CROSS-REFERENCE DATA TO RELATED APPLICATIONS

Applicant claims the priority benefits of U.S. Provisional Patent Application 60/515,067, filed Oct. 28, 2003; U.S. Provisional Patent Application 60/542,167, filed Feb. 5, 2004; and U.S. Provisional Patent Application 60/554,037, filed Mar. 16, 2004. This application is a continuation-in-part of U.S. Design patent application No. 29/209,236, filed Jul. 12, 2004, pending.

BACKGROUND OF THE INVENTION

This invention relates to containers, and in particular, to a water bottle adapted for use with a dispenser.

Presently, water is sold for home, office or retail use in large bottles. Bottles of this type usually include a generally cylindrical body, a generally frustoconical top breast at the upper end of the body, and a tubular filling and dispensing neck projecting upwardly from the central portion of the breast. Bottles of this type usually are inverted and installed on a gravity-type dispenser. In order to enable the bottle to be used with standard filling equipment, the diameter of the neck of the body is small in comparison to the diameter of the generally cylindrical body of the bottle. Most water bottles of this type, termed "carboys", are blow molded from a plastic such as polycarbonate, polyvinylchloride, polyethylene or polypropylene, and have a capacity typically of 3, 4 or 5 gallons. The molding is effected by extruding a hot plastic parison into a mold and by using compressed air to blow the plastic into a shape conforming to the mold. These bottles are designed for reuse, and may be of the type illustrated and described in U.S. Pat. No. 5,217,128, incorporated herein by reference. The typical duty cycle of such bottles is 20 to 50 recycles. The marketing system for the bottles filled with water includes delivery and pick-up services which require considerable investment and is considered to be quite labor intensive.

In recent years, large bottles imitating the shape of the existing cylindrical bottles have been formed of polyethylene terephthalate (PET). PET is recognized as a material which is superior in many respects to polycarbonate and polyvinylchloride for use in bottles and the like. PET is stronger than the more conventional materials and thus a more economical and lighter weight bottle may be produced by using PET, since less material is required to make a bottle of given size and strength. Also, PET has virtually no effect on the taste of the water or other beverage, and has superior clarity and transparency.

PET bottles, however, are not useful in a returnable mode because PET has limitations regarding temperature above 70 degrees C./160 degrees F. This does not allow the bottle made of PET to survive repeated washing at normal elevated temperatures required for sanitation purposes. Furthermore, such bottles tend to be quickly degraded by the rigors of outdoor storage and exposure to high temperatures of delivery trucks in the hot sunlight. Also, the sale of water in one-way 5 gallon PET bottles has been limited due to the weight of resin used in making the container and the consequent cost of the bottle when it is used once and then recycled.

In small one-way PET water bottles, the weight of resin per liter of contents drops from approximately 50 grams/liter to 20 grams/liter as the bottle size increases from 250 ml to 2 liters. It makes sense that the larger the container, the more efficient the use of resin would be. However, early designs of one-way PET carboys did not achieve this improvement and required 450 grams for a 5 gallon carboy, i.e., 24 grams/liter, mainly because of vacuum problems associated with dispenser-mounted bottles.

Lightweight PET carboys can collapse under the vacuum created by water as it is dispensed from the bottle and can fall off the dispenser spilling water out of the bottle onto the floor. The vacuum within the carboy can reach approximately 50 millibar (about 1 psi). This is not a large pressure, but applied to the side of a cylindrical container, it can produce a force of close to 50 pounds on a 5 inch wide×10 inch high area on the side of the container. In an attempt to solve this problem, designers have reduced the diameter of the cylinder carboy to 9 inches to make the carboy more rigid. However, this requires the carboy to be taller for the same volume and increases the amount of resin used.

It is a primary purpose of the present invention to produce a bottle for water which is light in weight, inexpensive, useful for one time use, and readily acceptable for present transportation configurations and dispensing equipment.

SUMMARY OF THE INVENTION

It has been discovered that the above objectives can be realized by a bottle having a basically spherical or elliptical shape, a footed base portion, with an optional unique neck geometry. The new and unique configuration results in a water bottle which is readily acceptable in any standard dispensing system and may be produced from PET in one of the known blowing techniques.

In one embodiment of the invention, the objects of the invention may be achieved by a plastic blow molded bottle comprising a main body portion including an upper hemispherical section and an associated lower hemispherical section, the upper section and the lower section being integrally interconnected; the upper section including an upwardly extending neck finish, and the lower section including a fitted base; and a reusable neck finish of a diameter different from the neck finish of the upper section of the main body, the reusable neck finish being selectably connectable to the neck finish of the upper section of the main body to provide a liquid-tight seal therebetween.

The invention begins with a spherical 5 gallon (approximately 19 liters) container which will have a resin/liter weight of only about 320 grams, or 17 grams/liter. The shape change results in a nearly 30% savings in resin weight over a traditional carboy shape.

A spherical shape has the lowest surface area per volume contained of any geometrical shape. A sphere will have a 14% geometric advantage over a 10.6 inch diameter cylinder in terms of surface area and of weight at the same wall thickness. The advantage rises to 20% when the carboy has a 9 inch diameter. Surface area times thickness is the determinant of resin volume used to manufacture the bottle. With regard to a vacuum, a sphere is the natural design choice to resist external pressures as evidenced by the fact that deep-water submersibles are all spherical in shape. The spherical shaped water bottle therefore allows the use of less resin to make a container of any given volume of contents, e.g., 3 gallons, 4 gallons, 5 gallons, etc.

The benefit of the shape of the plastic surface making up a spherical shape, i.e., a curved surface with a small radius of curvature, is important with a water bottle used on a dispenser. A water bottle used on a dispenser is subjected to a vacuum within the bottle as water is dispensed from the bottle interior. The vacuum exerts a force which tries to crush the bottle from the outside inward. The water bottle is also subjected to various and sundry mechanical pressures and impacts when being transported from a water source to a retailer outlet and from there to a consumer's home or office before it is placed onto a dispenser. A spherical surface will resist pressure and impact better than a flat surface. A spherical surface also provides better resistance to forces than a cylindrically-curved surface which has a curve in only one direction, i.e., horizontal, rather than the single, multi-directional curve of a spherical surface. Because cylindrical bottles do not have the natural structural resistance of spherical bottles, cylindrical containers must have horizontal ribs incorporated therein to resist compression forces generated by a vacuum. Ribs, however, are generally undesirable because they give a container a stiffness that, once overcome, leads to a permanent creasing that destroys the resistance of the rib rendering it ineffective against the vacuum force.

A sphere full of water will immediately, upon being subjected to an external force at one point (impact or force), generate an internal pressure increase which will counteract the force and prevent collapse of the container. This is also true of top load, which is the force that a bottle is subjected to when it is stacked in layers for storage or transportation such as on a pallet. It is almost impossible to collapse a full spherical bottle because this reactive force, contained by the resulting tension in the container walls, will not allow the bottle to collapse. In contrast, a cylinder, when subjected to top load, wants to become spherical, which it can only do by bending the side walls which under unstable conditions can buckle the side walls. When this happens, the walls will not be under tension (a stable condition) until the walls approach a spherical shape. Therefore, a sphere can have a thinner wall than a cylinder and have the same or better mechanical properties.

There is also a natural improvement in stability of the container when it is a sphere rather than a cylinder. A spherical container will have a lower center of gravity. A sphere is always balanced when being rotated, such as when a person is putting it onto the dispenser. In contrast, a cylinder's weight exerts a varying force on the person's arms as it is rotated and can cause loss of balance.

One drawback to spherical containers is that they have larger diameters than cylindrical containers. The existing transportation and display infrastructure, i.e., pallets, shipping boxes, truck cubby holes, racks, conveyors, shelves, etc., are all designed for the standard, 10.6 inch diameter, 5 gallon cylindrical carboy. A 4 gallon sphere would have a 12 inch diameter, while a 5 gallon sphere would have a 13 inch diameter making them incompatible with existing 10.6 inch systems.

The present invention addresses this problem in two ways. The present invention provides an elliptical variation of the spherical shape. The elliptical shape will also provide a multi-directional curve shape. An elliptical shape can also provide a bottle with a central, horizontal diameter equal to the current standard for polycarbonate and PET returnable bottles, i.e., 10.6 inches or 27 centimeters. A spherical container with this diameter would be limited to about 2.5 gallons. The current market requires bottles to contain 3, 4 and 5 gallons of water in each bottle to provide an economically competitive bottle. The elliptical or prolate spheroid shape is a preferred evolution and preferred alternative to a perfect sphere because it achieves the volume requirement and still has spherical curvatures in two directions, vertical and horizontal, although the curvatures have different radii.

Another way to address the spherical shape packaging problem is by forming flat spots on the equator of the sphere, thereby reducing spacing between bottles without substantially penalizing the spherical-oriented design in terms of volume contained. The use of flat spots allows close packing of the bottles for maximum packing density. The sphere only has to be made slightly larger in diameter to return the capacity to its original value after making flat spots.

Another advantage of a spherical bottle with flat spots is that a guiding surface is created which will allow the bottle to maintain its orientation relative to filling, labeling, capping, palletizing, and other equipment which might benefit from the ability to maintain the orientation of the bottle. Furthermore, during shipment the bottles will not tend to rotate and scuff against each other. The flat spots will provide a larger contact surface and, therefore, a lower pressure point caused by inter-bottle contact and vibration during transportation. Since standard 5 gallon containers filled with water are quite heavy, i.e., 43 pounds, in the present invention, the preferred bottle capacity is between 3 and 4 gallons for reduced weight and ease of handling. The 4 gallon container with flat spots will have a flat spot to flat spot, side-to-side dimension which is the same as diameter of a traditional 5 gallon, cylindrical carboy, i.e., 27 centimeters or approximately 10.6 inches. Another advantage of a container with flat spots is that labels can be placed on the flat areas.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF INVENTION

Figure 1:
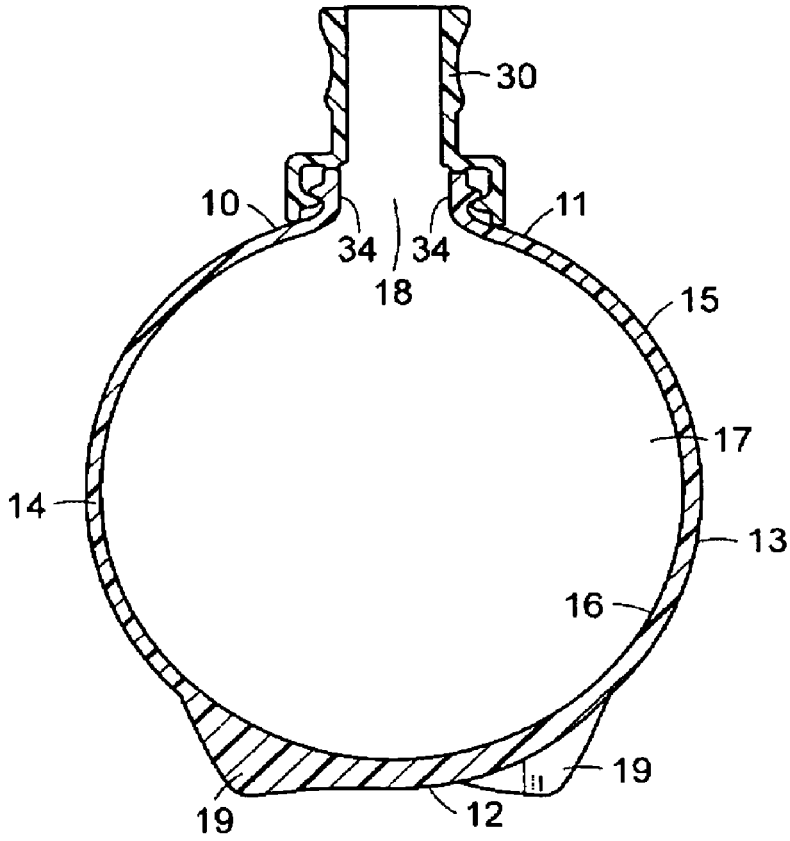
FIG. 1 is a cross sectional view of a spherically shaped water bottle for a dispenser.

Referring to the drawings in detail wherein like elements are indicated by like numerals, there is shown a water bottle 10 constructed according to the principles of the present invention. The water bottle 10 has a top 11, bottom 12, a wall 13 extending from the bottom 12 to the top 11, said wall having an equator 14, an outer surface 15 and an inner surface 16, said wall 13 defining a water bottle interior 17. The water bottle top 11 has an orifice or neck 18 through which the bottle is filled or emptied. The bottle 10 is adapted to sit upside down on the top of a water dispenser (not shown) for home or office use. The bottle neck 18 is inserted into a dispenser top reservoir.

Figure 5:
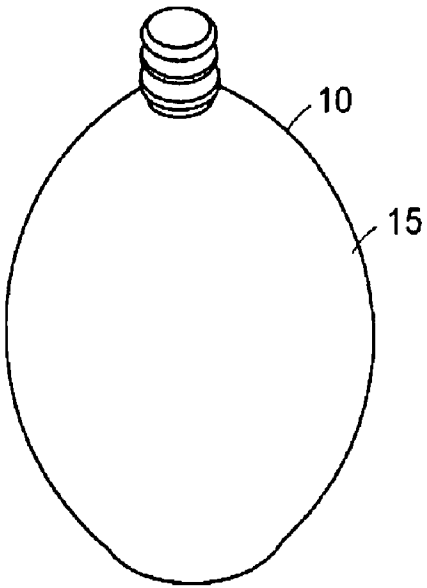
FIG. 5 is a perspective view of the preferred oval embodiment of the invention.
Figure 8:
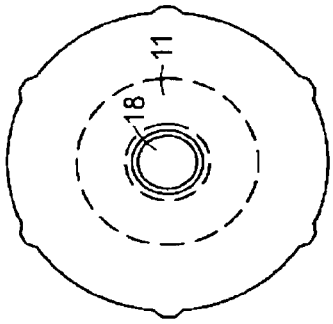
FIG. 8 is a top view thereof.
Figure 9:
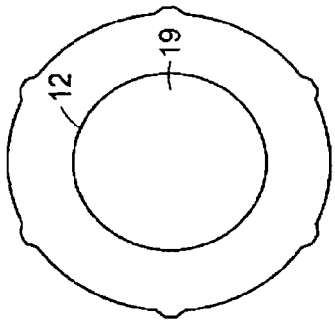
FIG. 9 is a bottom view thereof.
Figure 11:
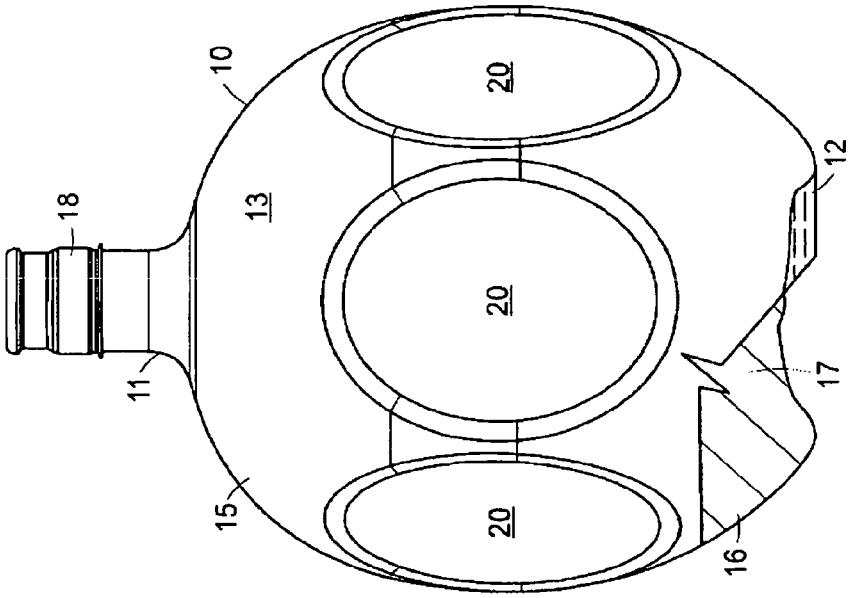
FIG. 11 is a front view, partly in section, thereof.
Figure 10:
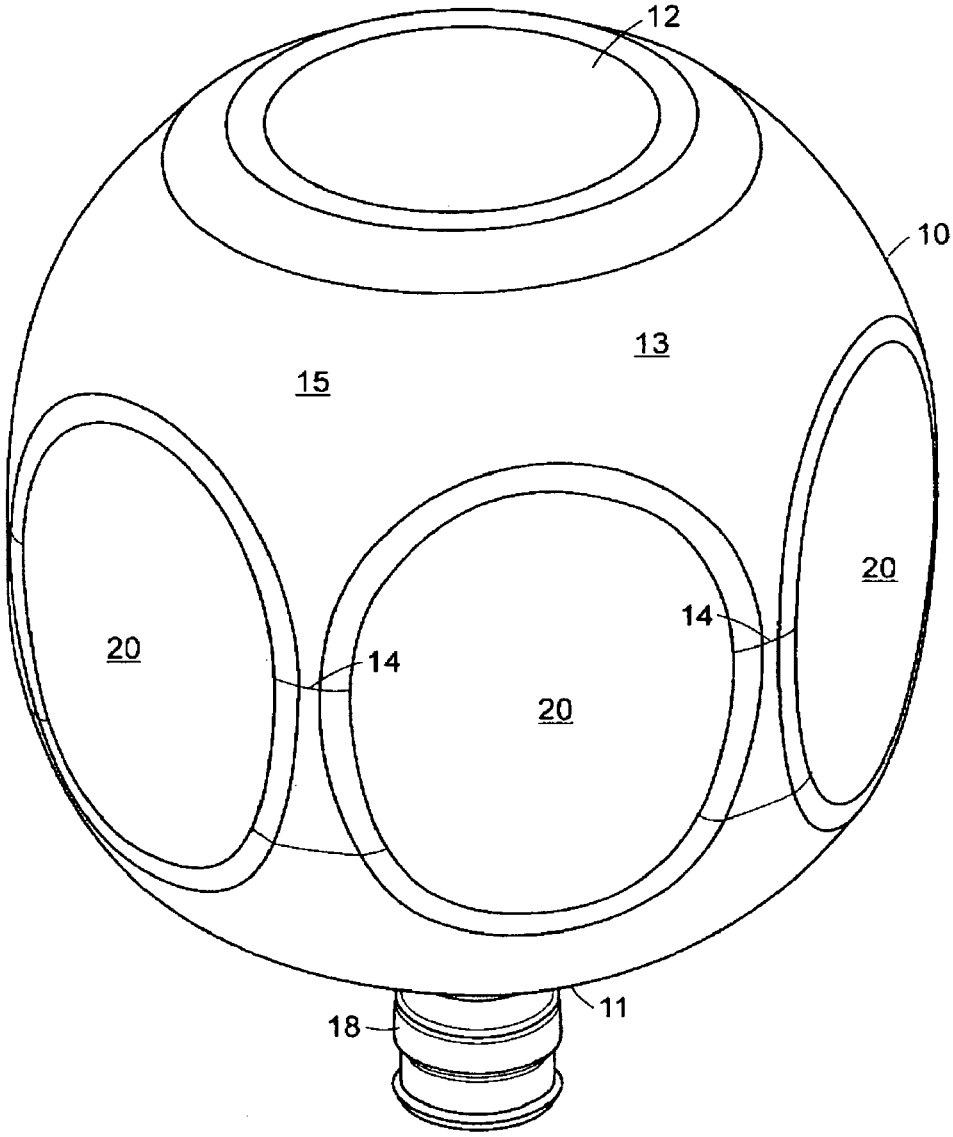
FIG. 10 is a bottom perspective view of a water bottle with flat areas.
Figure 12:
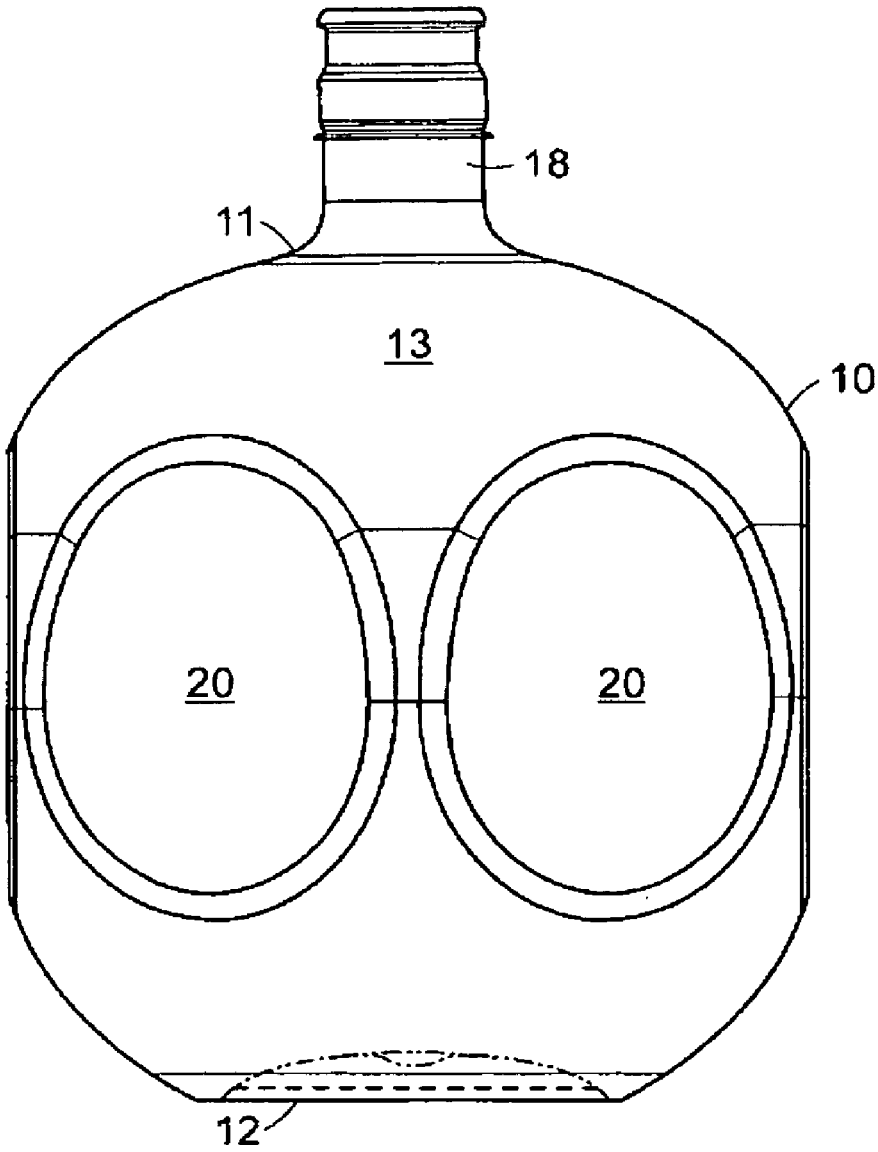
FIG. 12 is a side view thereof.

In one embodiment of the invention the wall 13 has a spherical shape. See FIG. 1. In another embodiment of the invention the wall 13 has an oval shape. See FIG. 5. In another embodiment of the invention, the wall 13 has a plurality of flat areas 20 about its equator 14, said flat areas being equispaced about said equator 14. See FIG. 10. In another embodiment of the invention, the water bottle's capacity is increased by adding a short cylindrical section to the middle of the container, i.e., expanding the equator. This will allow more volume to be contained in a bottle with a smaller diameter. The above embodiment may be combined with the flat area embodiment for a third embodiment, wherein a waisted bottle with a plurality of flat equator areas may be provided. See FIG. 12.

The uniqueness of these embodiments is the combination of a spherical shape which has certain mechanical characteristics and the flat areas that provide desirable bottle spacing characteristics plus stiffening where the flat and curved surfaces intersect. The stiffening acts like a rib without actually putting any in the bottle. Most prior art bottles have ribs that provide top load resistance and side load resistance. The sphere characteristics of the present invention, combined with the incompressible liquid inside, provides this resistance so that ribs are not needed.

The water bottle could have any type of base 19, be it part of the container like a "champagne" (slight cup) type or a footed base of 3, 4 or 5 feet, or an extended base that is round below the spherical surface. The base could also be separate and held in place by an adhesive like a base cup. A simple ring or section of a tube could be an adequate base to allow the bottle to stand in a stable position for filling, capping, storage or shipping.

Figure 2:
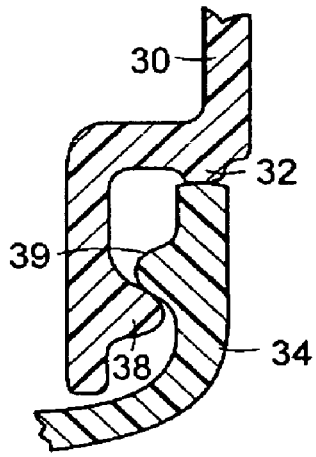
FIG. 2 is an enlarged fragmentary view of a portion of the dispensing neck finish of the bottle illustrated in FIG. 1.
Figure 4A:
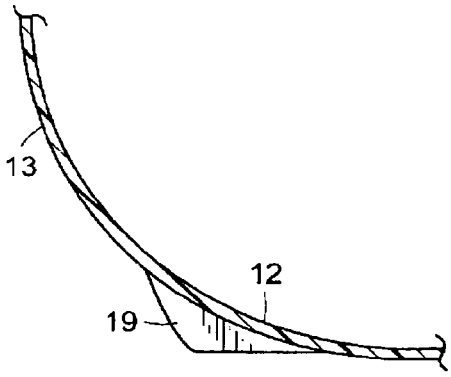
FIG. 4A is a fragmentary view of a minimal undercut foot design for the base of a spherical portion of a bottle.
Figure 4B:
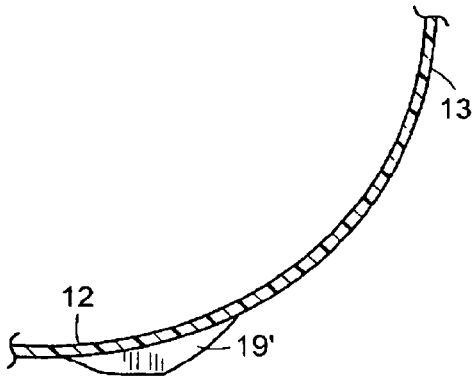
FIG. 4B is a fragmentary view of a conventional foot design for the base of a spherical portion of a bottle.
Figure 7:
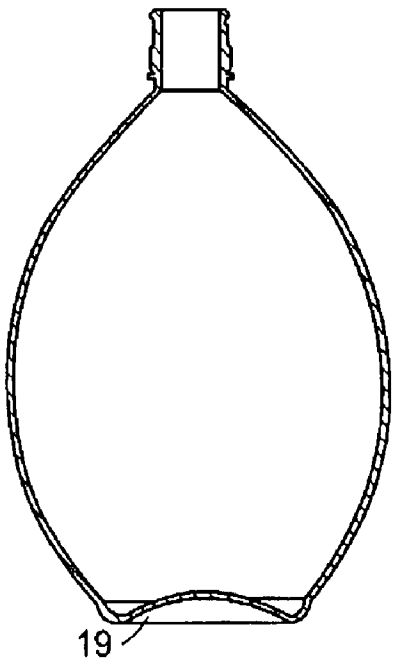
FIG. 7 is a section view along the line 7—7 of FIG. 6.
Figure 6:
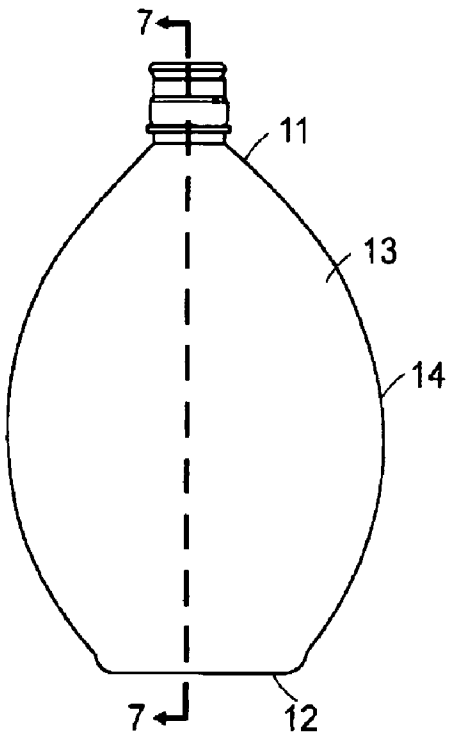
FIG. 6 is a side view thereof.

Referring to FIGS. 2 and 4, there is illustrated the relative difference between a newly designed footed base 19 and the traditional footed base 19'. The traditional footed base 19' creates an undercut such that the foot cannot be readily extracted by moving the mold laterally. The undercut is mainly created to increase the clearance between the central point on the bottle 10 and the lower extremity of the foot. Typically, this design is used due to the pressure considerations for bottles containing carbonated beverages. For still product such as water the clearance does not need to be as great.

The spherical shape of the present invention water bottle may be modified with other geometric shapes, such as cylindrical sections as described above, trapezoidal frustums or cones or pyramids, or other shapes to form a base or to add volume to the sphere without increasing its diameter.

Figure 3:
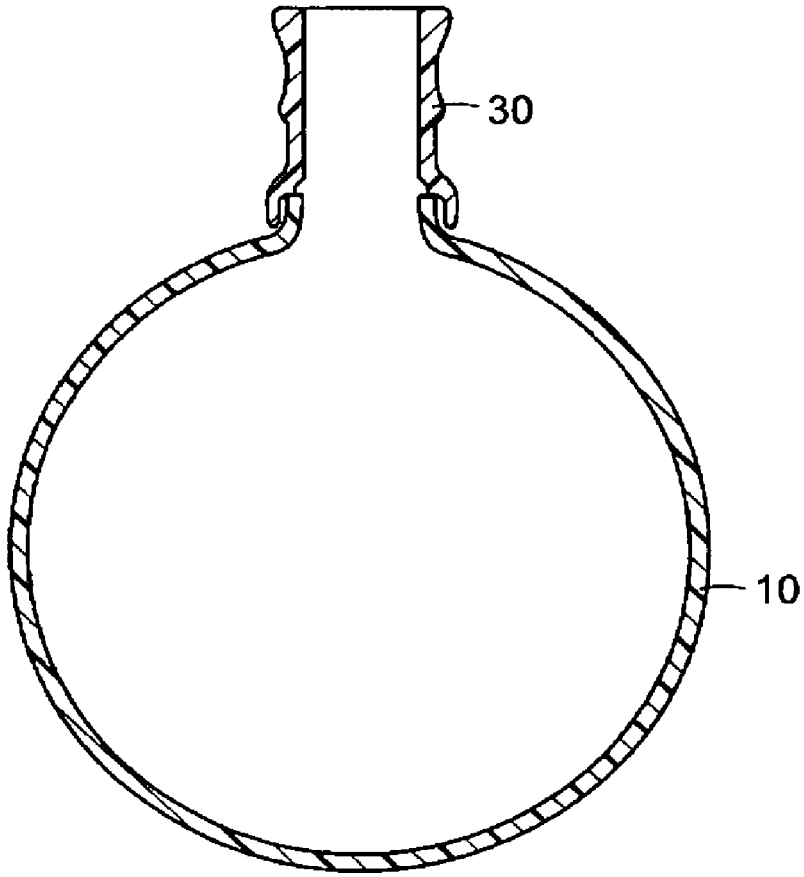
FIG. 3 is a cross sectional view of a spherical container showing a removable neck portion for the finish of the main spherical body.

Referring to the drawings and more particularly, FIGS. 1–3, there is illustrated in FIGS. 1 and 2 a removable dispensing neck finish 30 for a spherically shaped bottle 10 for the retail sale of water, for example. Basically, the bottle 10 is formed with a hemispherically shaped upper portion with an integrally formed neck finish 30 and a hemispherically shaped lower portion with a footed base 19. A removable neck finish 30 is formed to have the same exterior configuration as the bottles presently in use and as illustrated in the above noted patent. The resulting structure will function in any standard dispensing system. It will be observed that the spherically shaped bottle 10 is formed from blow molded spheres. The neck 34 of the upper section of the upper section of the spherical bottle 10 is larger in diameter than the neck finish required to conform with existing dispensing equipment. The size of the neck 34 is brought about by the preferred size of the neck finishes compared to the diameter of the associated spherical body of the bottle formed by the typical blow molding operation.

Accordingly, it is contemplated that the size or diameter of the neck finish of the spherical bottle 10 may be achieved by the addition of a removable dispensing neck portion 30. The neck portion 34 may have internal threads formed integral therewith adapted to receive external threads on the removable neck finish 30. In such an embodiment it may be necessary to provide an extra seal mechanism to create a liquid-tight seal between the neck finish 34 of the bottle 10 and the associated removable neck finish 30. Such a seal may be created by forming an integral depending annular sealing head 32 on the internal surface of the removable neck 30.

It will be understood that while a threaded attachment has been illustrated and described to achieve the desired connection between the removable neck finish 30 and the neck 34 of the bottle 10, a snap connection 38, 39 may also be employed. In the event it were found desirable, a secondary, as well as a primary, seal may be utilized to produce the desired seal between the removable neck finish 30 and the neck finish 34 of the bottle 10.

A neck extension contemplated by the invention requires that the bottle have a thread upon which a cap will seal the orifice. In addition to having the cap, it may be desirable to have another foil seal to prevent tampering with the contents of the bottle. This would also reduce the risk of leaks.

Typically, the neck finish of the known bottles is a heavy portion of the package and consumes a considerable amount of resin. Thus, if the bottle is designed for one-way use, the heavy neck finish is an integral part of each bottle. By making the neck finish reusable, considerable weight is saved in every bottle. In a typical 3-gallon spherical bottle formed of plastic including a neck finish, the total weight of plastic is in order of 260 gms, of which the neck finish would be approximately 60 gms. Accordingly, without the neck finish, the shipping weight of the bottle would be merely 200 gms rather than 260 gms.

Further, it has been found that with improved blow molding techniques and preform design, the neck finish is typically larger than the standard neck finish compared to the bottle diameter. With the teachings of the present invention, optimum blow molding procedures may be employed in forming a spherical bottle which may readily receive a removable neck finish to accommodate the large bottle neck opening. Blow molding a large diameter bottle with a large neck opening is easier than blow molding one with a smaller neck opening.

The neck extension could contain a method of puncturing the seal as the bottle is inserted into a dispenser. The neck extension could have a sharp surface that penetrates the seal when the extension is screwed onto the bottle. Alternatively, the tip of the dispenser probe that penetrates the "non-spill" bottle cap, allowing water to flow to the dispenser, could be modified to become long enough to penetrate the foil seal.

Referring more particularly to FIGS. 5 through 9, the present invention provides an elliptical variation of the spherical shape. An elliptical shape will provide a bottle with a diameter equal to the current standard for polycarbonate and PET returnable bottles, i.e., 10.6 inches or 27 centimeters. A spherical container with this diameter would be limited to about 2.5 gallons. The current market requires bottles to contain 3, 4 and 5 gallons of water in each bottle to provide an economically competitive bottle. The elliptical or prolate spheroid shape is a preferred evolution and preferred alternative to a perfect sphere because it has a spherical curvature in two directions, vertical and horizontal.

Figure 13:
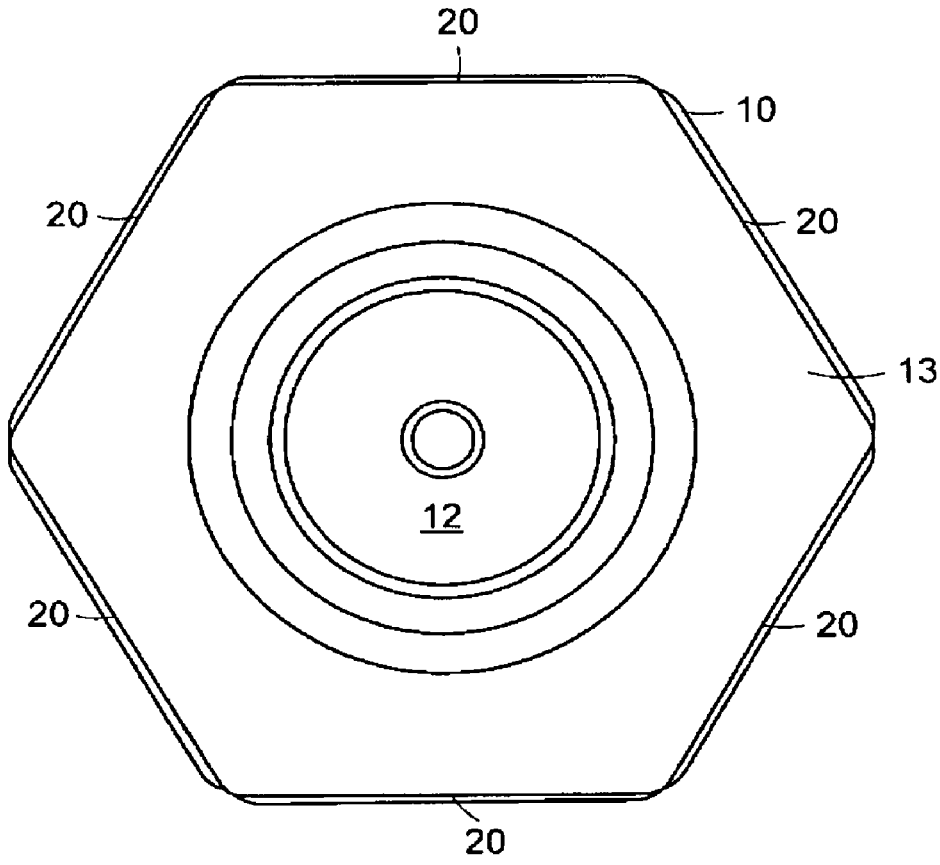
FIG. 13 is a bottom view thereof.
Figure 14:
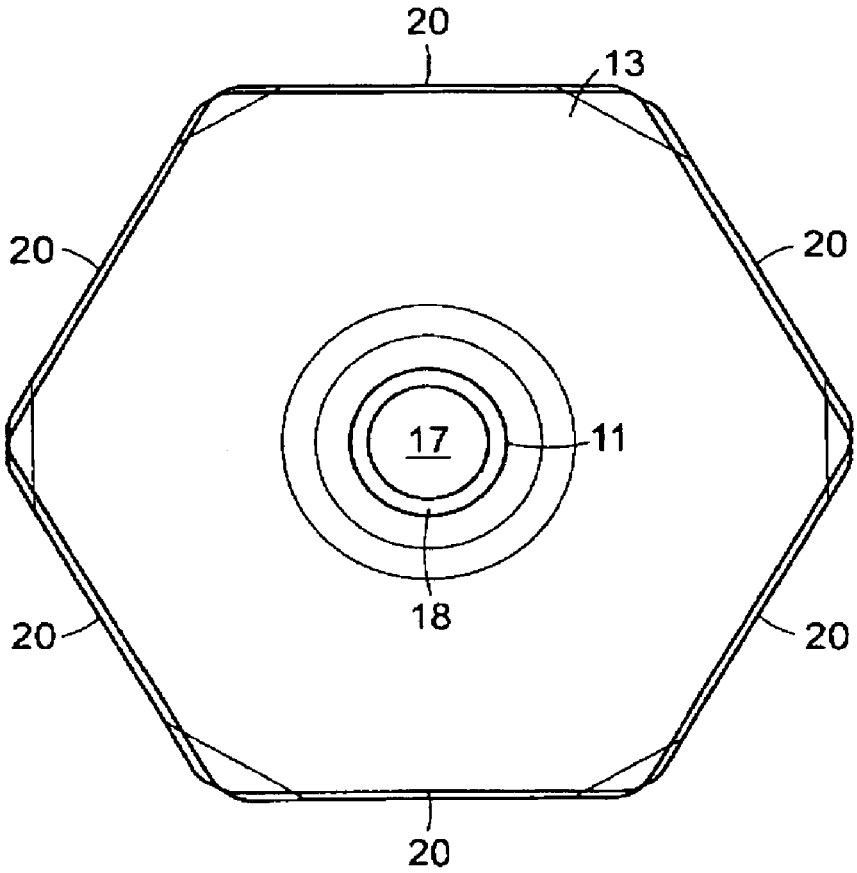
FIG. 14 is a top view thereof.
Figure 15:
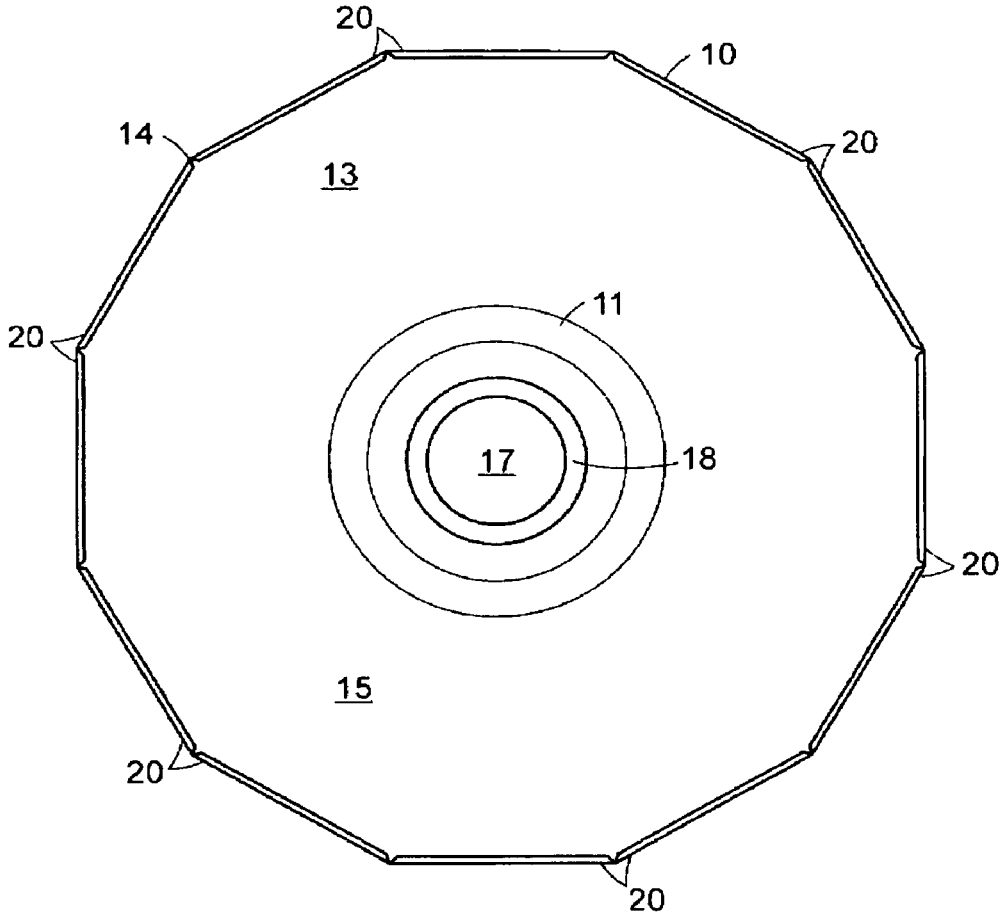
FIG. 15 is a top view of another embodiment of the invention.
Figure 16:
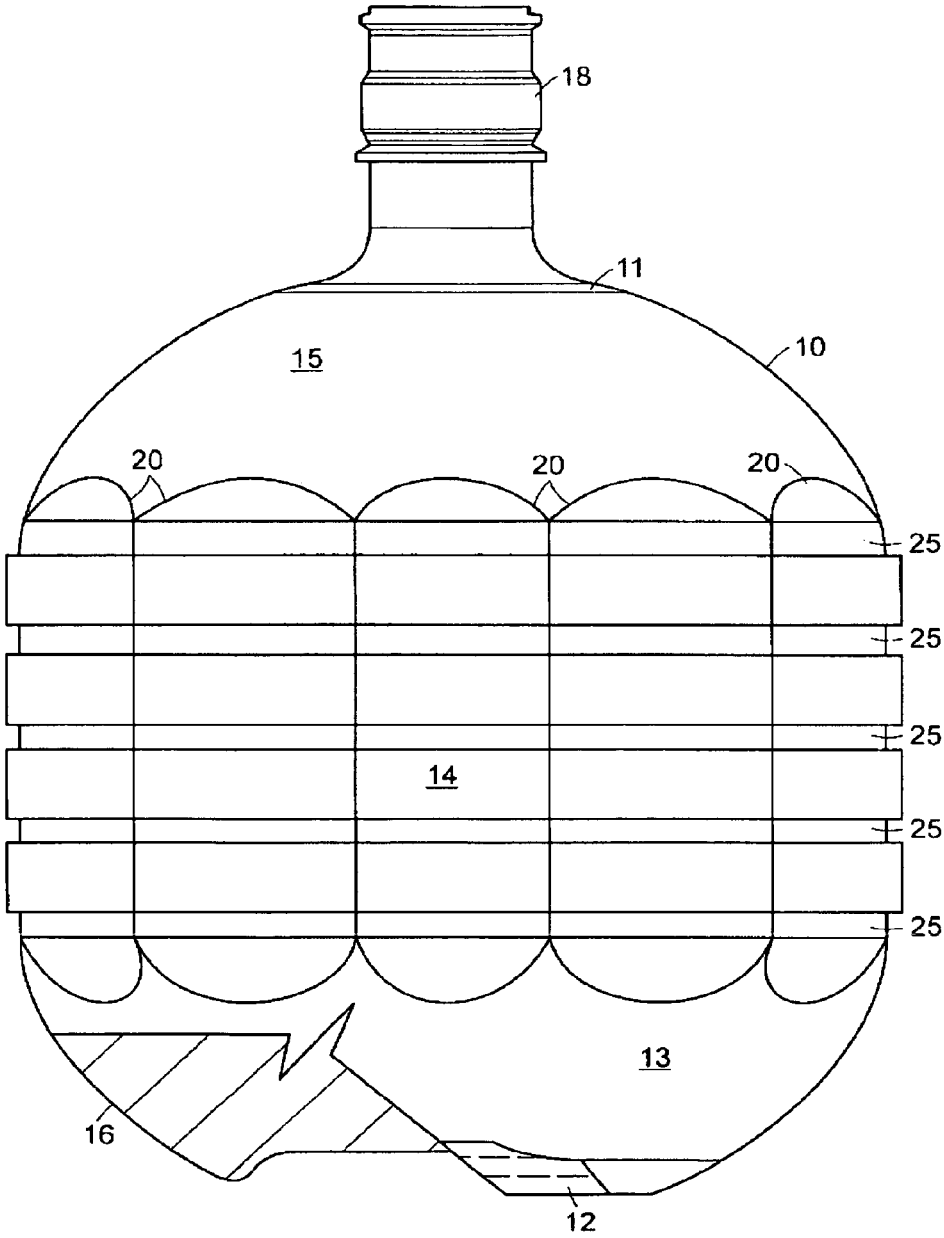
FIG. 16 is a side view thereof.
Figure 17:
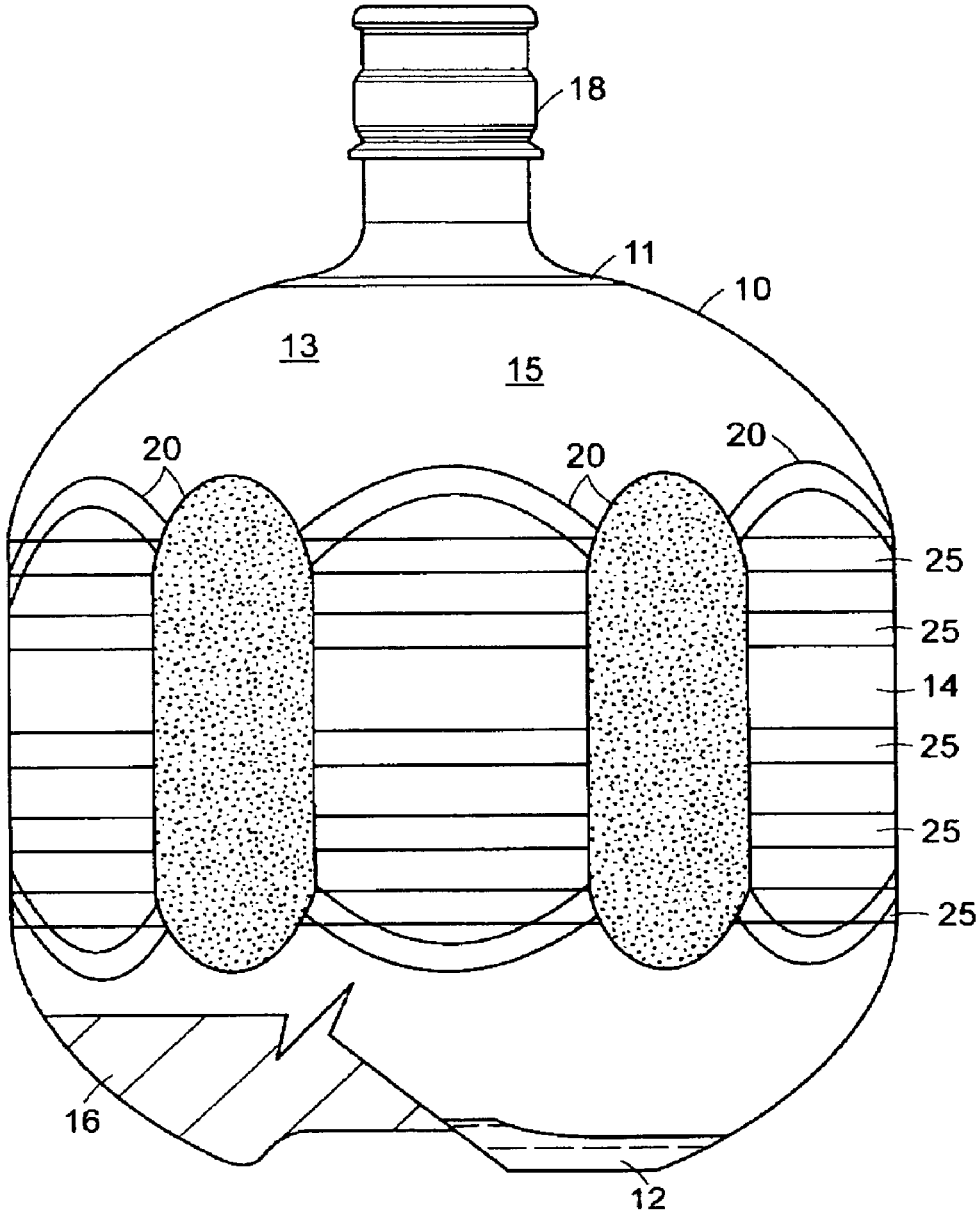
FIG. 17 is a comparative side view of the first embodiment superimposed on a hexsphere bottle.
Figure 18A:
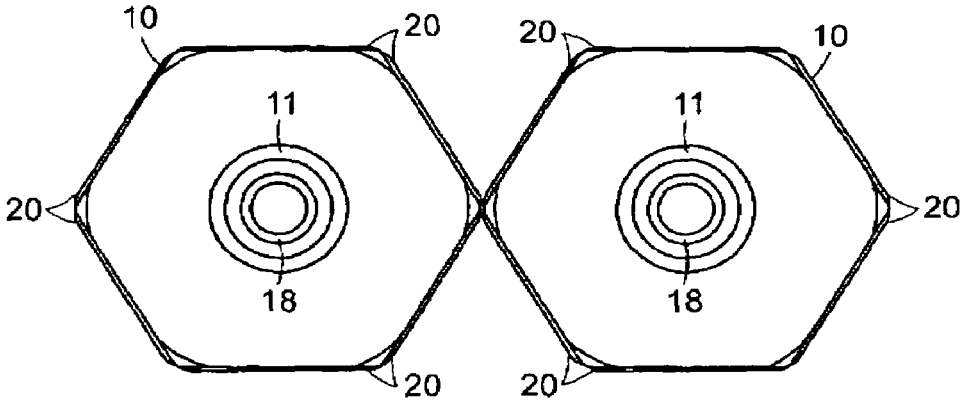
FIG. 18A is a top view of two hexsphere bottles arranged side-by-side.
Figure 18B:
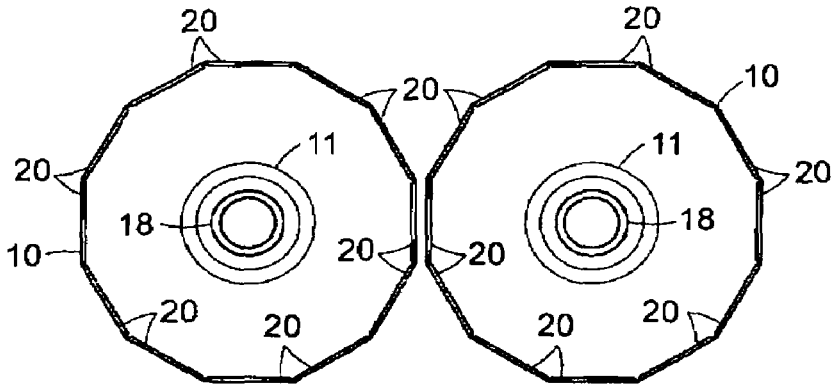
FIG. 18B is a top view of two twelve panel bottles arranged side-by-side.
Figure 19:
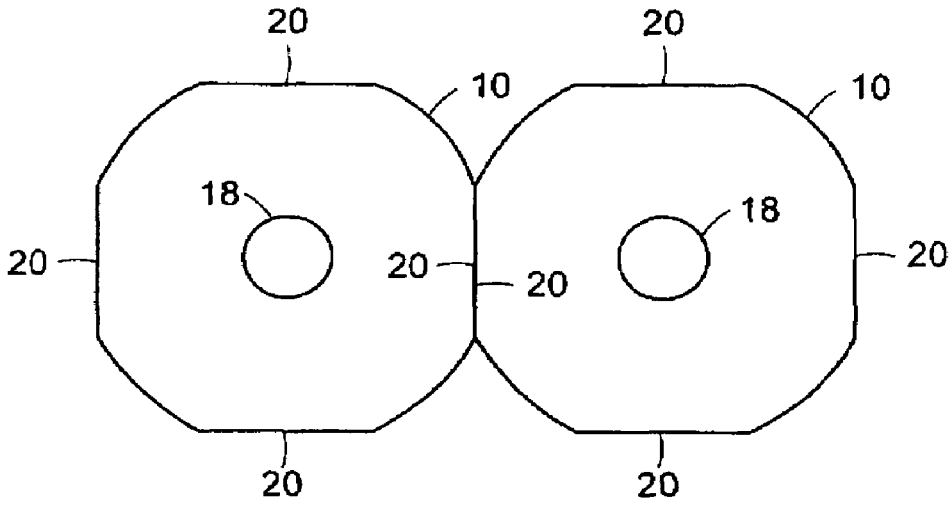
FIG. 19 is a top view of a second embodiment of the invention.
Figure 20:
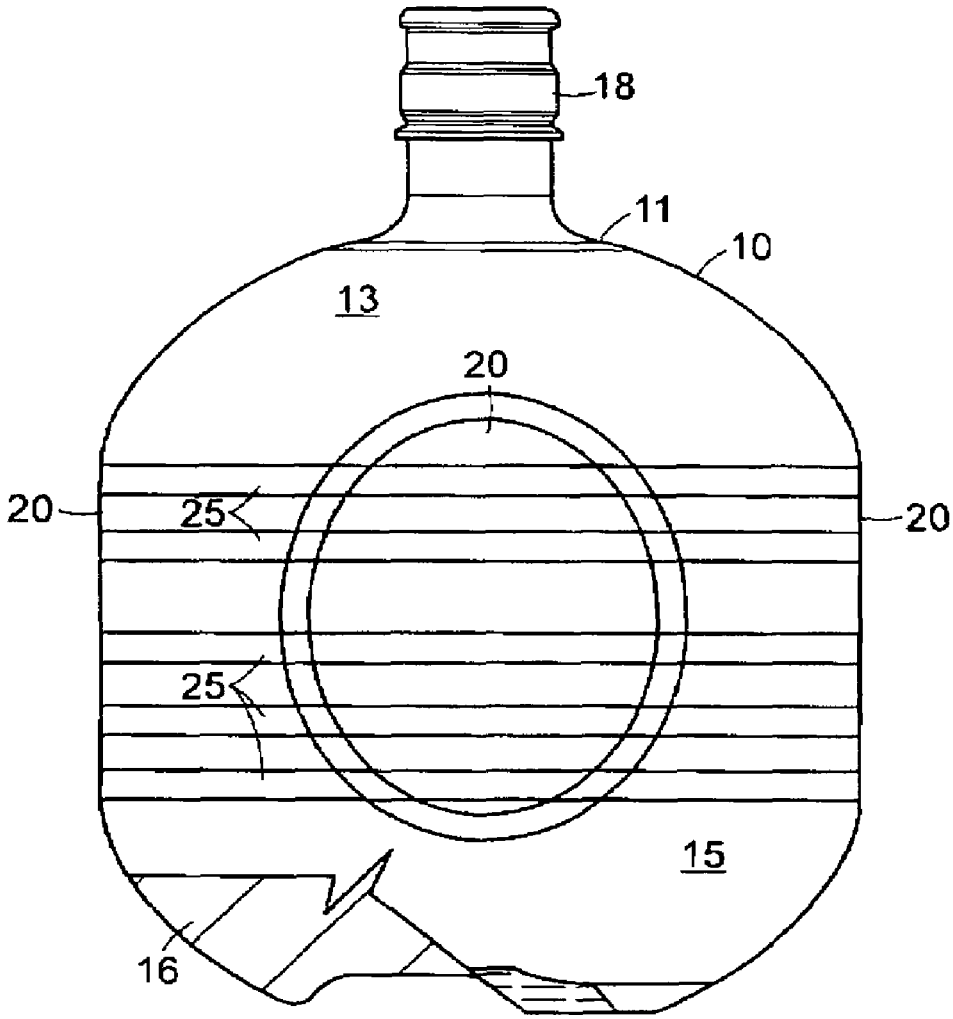
FIG. 20 is a side view of the second invention embodiment.

Referring particularly to the drawings, there are shown three embodiments of water bottles with flat panels. FIGS. 13 and 14 illustrate a six panel bottle. FIGS. 15 through 17 illustrate a twelve panel bottle. FIG. 19 illustrates a four panel bottle. Each has advantages and disadvantages.

Applicant originally developed a hexsphere, one-way, large, dispenser-mounted, water bottle. This bottle had six flat panels about its equator to reduce the spacing of the bottles when placed on a pallet. It was found, however, that when the bottles were fed through a filling line which has conveyors that carry the bottles to the filler nozzles, the bottles did not contact each other face-to-face, but contacted point-to-point. This means that the bottle neck spacing was 30 cm while the nozzle spacing was 27 cm. During testing applicant also found that when the hexsphere bottle was mounted on a dispenser, the equator area where the six flat panels are located was weak and would not resist the vacuum created when the water exited the bottle. It was also found that the flat panels did not line up, front to back, when the bottle was put into conveyor with guides on either side of the bottle. This means that the bottle necks were not spaced apart by the standard 27 cm as used throughout the dispenser water industry.

To strengthen the equator area of the bottle, applicant has provided a bottle with twelve smaller flat panels to replace the previous six larger flat panels of the hexsphere design and also to reduce the diameter of the bottle at the point where bottles touch each other when lined up on a conveyor. The addition of six more panels which will intersect the other six panels that exist on the previous hexsphere design, forming a straight vertical bend in the plastic, is intended to strengthen the panel area. This is done by two effects, i.e., the presence of the vertical bend and also the reduction of the size of the flat areas (panels) that exist on the hexsphere bottle. From 3 to 5 horizontal ribs are also added as additional strengthening elements. Each rib has an approximate 1 cm height and between a half and one cm depth. Ribs that are located circumferentially on a bottle will strengthen the bottle against compressive forces such as the vacuum-like forces that dispenser bottles are subjected to.

The twelve equator area flat panels of this invention embodiment reduce the effective diameter of a spherical bottle, thereby providing a point-to-point spacing for filling of 27 cm rather than the original 30 cm. The 12 panel design provides a larger bottle, i.e., more contents, for a given bottle height, although it has the disadvantage of requiring ribs to keep the bottle from collapsing under vacuum. The flat panels weaken the spherical shape causing the bottle to collapse without the ribs.

Therefore, there are illustrated a water bottle having flat equatorial panels and constructed according to the principles of the present invention. The water bottle 10 has a spherical shape with a top 11, bottom 12, a spherical wall 13 having an equator 14, an outer surface 15 and an inner surface 16, said wall 13 defining a water bottle interior 17. The wall 13 has a plurality of flat areas 20 about its equator 14, said flat areas 20 being equispaced about said equator 14. The water bottle top 11 has an orifice or neck 18 through which the bottle is filled or emptied. A plurality of horizontal reinforcing ribs 25 may also be provided to resist compressive forces as the bottle empties into a dispenser. Each rib 25 has an approximate 1 cm height and between a half and one cm of depth. Preferably three to five reinforcing ribs 25 are used, although more than five could be used.

In another embodiment of the invention a bottle is provided with four flat sides. Although this embodiment does not palletize as well as the hexsphere or the twelve-sided bottle, this version satisfies the filling conveyor width and bottle separation requirements. This embodiment has more spherical surface that the hexsphere and the diameter of the sphere before lopping off the panel areas can be smaller because fewer areas are made flat. The horizontal ribs that are added to the first embodiment are required strengthening elements for this embodiment as well. A disadvantage of the four sided embodiment is that the bottles must be arranged in a cubical arrangement on pallets instead of in a hexagonal arrangement which is more efficient in terms of packing density.

The bottle's capacity may be increased by adding a short cylindrical section 26 the middle of the container, i.e., expanding the equator by increasing its waist. This will allow more volume to be contained in a bottle with the same diameter. See FIG. 21.

Another advantage of using four or twelve flat panels over the hexsphere (6 panels) is that when lying down to make a display, the hexsphere bottles cannot lie with a flat side on the floor and have flat panels touching flat panels side-to-side. When hexsphere bottles are placed together with the flat panels touching, the points are up and down, so the floor-level bottles have to rest on a point.

Figure 21:
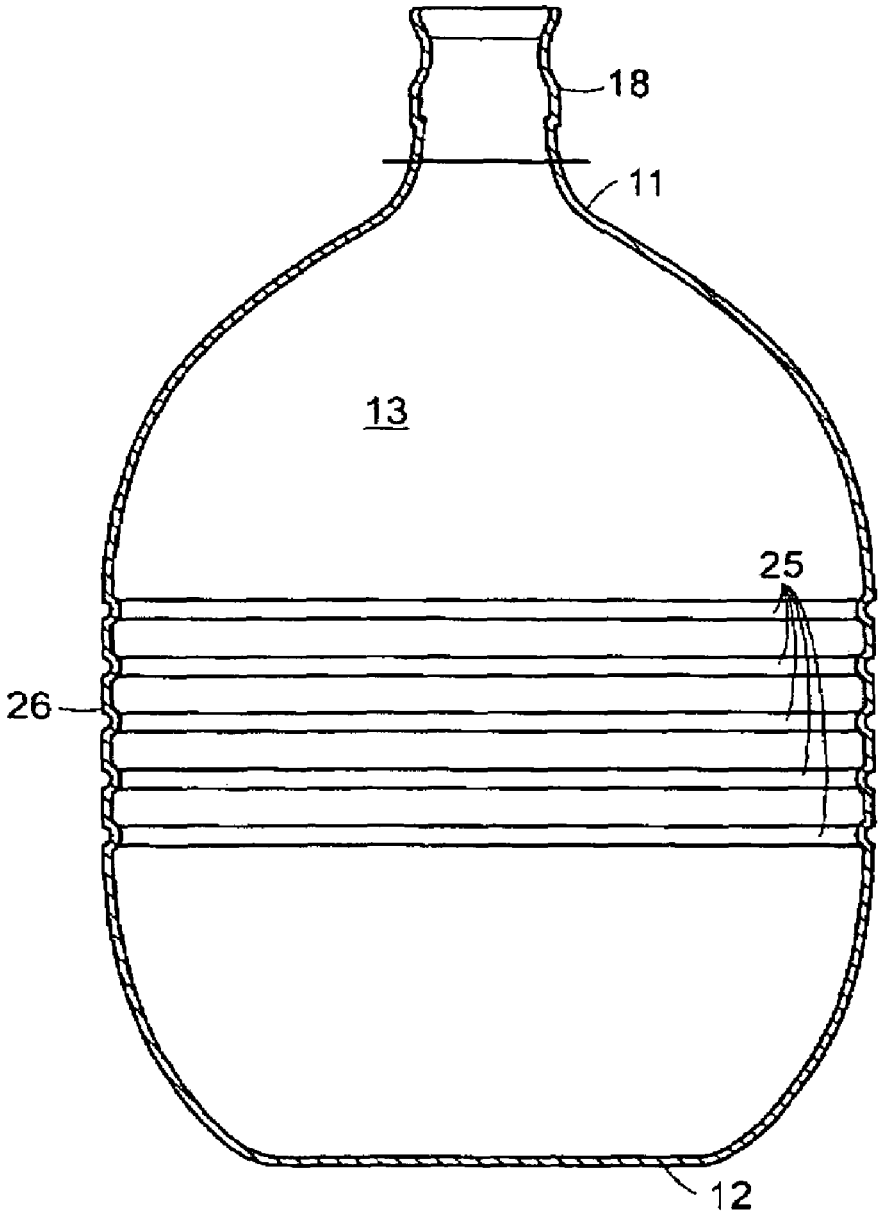
FIG. 21 is a side view of an invention water bottle with reinforcing ribs.

It is understood that the above-described embodiments are merely illustrative of the application. Other embodiments may be readily devised by those skilled in the art which will embody the principles of the invention and fall within the spirit and scope thereof. For example, more or less flat equatorial areas may be provided, the upper limit being an infinite number which forms the cylindrical equatorial surface 26 as shown in FIG. 21.

The water bottle can be made thicker or thinner in different areas depending on the impact or stress that said area of the bottle is expected to receive in use. For instance, the shoulder area will receive the top load and should be thicker than the equator area. The base should also be thicker so that when dropped, the base area will not dent. Typical thicknesses for PET would be: thin at 0.02 cm, thick at 0.15 cm, and average at approximately 0.04 cm. Because the spherical shape has its largest diameter at the equator and it is precisely this area which sees more "stretch" of the cylindrical preform from which it is made, the thickness of the bottle wall can be precisely controlled to produce this gradual variation from thick to thin to thick again from the neck to the base.

Other resins could be contemplated although presently there are none that applicant is aware of that are as good as PET for water in terms of resin strength or transparency. For instance, HDPE-high density polyethylene, a common resin used for bottles such as milk bottles, could be used in some applications for which stretch blow molding is not required or desirable and extrusion blow molding would be better. Another resin, PP-polypropylene, could be used in cases in which high temperature resistance was required. PP bottles could be made by stretch blow molding or by extrusion blow molding.

Other applications such as for powders like detergents and industrial granular materials, chemical liquids, other drinks or concentrates such as soft drink syrup, make changes in neck design desirable. A threaded cap might be desired. The gas barrier properties of PET-polyethylene terephthalate are superior to those of the other plastics listed and also to those of PC-polycarbonate, from which water bottles are currently made.

The use of injection molding to make the preform used in two-step injection stretch blow molding allows the shape of the neck to be more precise than for bottles that are made by extrusion blow molding, e.g., PC returnable bottles. This avoids cap leakage which is prevalent when PC bottles are used for delivering water.

The PET resin (a polyester) is a natural choice for one-way (non-returnable) bottles because it is an inexpensive material with a strength that allows bottle walls to be very thin, thus reducing the weight of resin consumed. It is also a common resin used for one-way containers such as small water bottles, which are recycled commonly into carpeting and fleece clothing such as that sold under the brand name "Patagonia".

I claim:

1. A plastic, blow-molded, disposable water bottle adapted to sit upside down on the top of a water dispenser, comprising:

a top having a neck through which the bottle is filled and emptied, said neck being inserted into a dispenser top reservoir;

a bottom;

a prolate spheroid wall extending from the bottom to the top, said wall having an equator, an outer surface and an inner surface, said wall defining a water bottle interior, said wall having a spherical shape, said wall being made from PET-polyethylene terephthalate resin;

a plurality of flat areas about said wall equator, said flat areas being equispaced about said equator; and a plurality of circumferential ribs formed in said wall through said flat areas.

2. A plastic, blow-molded, disposable water bottle adapted to sit upside down on the top of a water dispenser, comprising:

a top having a neck through which the bottle is filled and emptied, said neck being inserted into a dispenser top reservoir;

a bottom;

a wall extending from the bottom to the top, said wall having an equator, an outer surface and an inner surface, said wall defining a water bottle interior, said wall having a spherical shape, said wall being made from PET-polyethylene terephthalate resin;

a cylindrical section about said wall equator, said cylindrical section having a plurality of flat areas about said wall equator, said flat areas being equispaced about said equator; and a plurality of circumferential ribs formed in said wall through said cylindrical section and flat areas.

* * * * *